US012523378B2

(12) United States Patent
Flaig

(10) Patent No.: US 12,523,378 B2
(45) Date of Patent: Jan. 13, 2026

(54) CEILING RADIATOR HAVING A STAR-SHAPED CROSS-SECTIONAL SHAPE

(71) Applicant: ALLFEST GMBH, Aldingen (DE)

(72) Inventor: Hartmut Flaig, Aldingen (DE)

(73) Assignee: ALLFEST GMBH, Aldingen (DE)

( * ) Notice: Subject to any disclaimer, the term of this patent is extended or adjusted under 35 U.S.C. 154(b) by 134 days.

(21) Appl. No.: 18/289,831

(22) PCT Filed: Apr. 19, 2022

(86) PCT No.: PCT/EP2022/060299

§ 371 (c)(1),
(2) Date: Nov. 7, 2023

(87) PCT Pub. No.: WO2022/238084

PCT Pub. Date: Nov. 17, 2022

(65) Prior Publication Data

US 2024/0240800 A1 Jul. 18, 2024

(30) Foreign Application Priority Data

May 14, 2021 (EP) ..... 21173863

(51) Int. Cl.
*F24D 3/16* (2006.01)
*F24F 5/00* (2006.01)

(52) U.S. Cl.
CPC ..... *F24D 3/165* (2013.01); *F24F 5/0092* (2013.01)

(58) Field of Classification Search
CPC ..... F24D 3/165; F24F 5/0092; F28D 1/053; F28D 2021/0035; Y02B 30/00; F28F 1/14; F28F 1/16
USPC ..... 165/53
See application file for complete search history.

(56) References Cited

U.S. PATENT DOCUMENTS 5,950,720 A * 9/1999 Klix ..... F24F 5/0092 237/70

FOREIGN PATENT DOCUMENTS

| | | | |
|---|---|---|---|
| DE | 19615419 | C1 | 6/1997 |
| DE | 19617718 | A1 | 10/1997 |
| DE | 29804240 | U1 | 8/1998 |
| DE | 102011053206 | A1 | 3/2013 |
| DE | 102014226713 | A1 | 6/2016 |
| KR | 20110009431 | U | 10/2011 |

OTHER PUBLICATIONS

International Search Report Dated Jul. 5, 2022 for corresponding application PCT/EP2022/060299.
European Search Report Dated Nov. 19, 2021 for corresponding application EP21173863.8.

* cited by examiner

*Primary Examiner* — Steve S Tanenbaum
(74) *Attorney, Agent, or Firm* — Bachman & LaPointe, P.C.

(57) ABSTRACT

A ceiling radiator (01) for heating or cooling rooms (14), the ceiling radiator (01) having at least one flow tube (03) for transport of a heating or cooling medium and having several radiant panels (04) connected in a heat-conducting manner to the at least one flow tube (03). The ceiling radiator (01) may have a star-shaped cross-sectional shape with five or more star tips (02), wherein at least two converging radiant panels (04) form a star tip (02) and at least one flow tube (03) is disposed in the center (M) of the star-shaped cross-sectional shape.

11 Claims, 3 Drawing Sheets

CEILING RADIATOR HAVING A STAR-SHAPED CROSS-SECTIONAL SHAPE

BACKGROUND OF THE INVENTION

The present invention relates to a ceiling radiator.

Generic ceiling radiators are used for heating or cooling rooms. In this case, several rod-shaped ceiling radiators are preferably suspended from the ceiling in order to heat the room by means of emitted heat radiation or by means of absorbed heat radiation.

From DE 298 04 240 U1, a ceiling radiator is known, radiant panels being connected to each other by means of connection elements in such a manner that a regular multangular/polygonal cross-sectional shape is formed. In this case, all corners of the cross-sectional shape are preferably uniformly disposed on a circle. Flow tubes are disposed in the connection elements at the corners of the cross-sectional shape or in the hollow space in the center of the cross-sectional shape in order to conduct a heating or cooling fluid. The individual ceiling radiators are rotatably mounted on the ceiling by means of a support, no preferred orientation with regard to the heat radiation being mentioned.

In DE 10 2011 053 206 A1, a ceiling radiator is disclosed which is also suitable for heating or cooling rooms, the ceiling radiator realizing a collection system for a condensate. A cross-shaped cross-sectional profile is disclosed which has four cross tips having converging radiant panels such that a condensate flows to the cross tips and can be collected in a collecting channel. In this case, the suspension is realized in such a manner that one cross tip points in the direction of the floor in order to drain off liquid at this cross tip by means of a collecting channel.

SUMMARY OF THE INVENTION

Based on the aforementioned state of the art, the present invention is based on the object of proposing a ceiling radiator which can emit or absorb a greater amount of heat radiation energy in the floor direction compared to a ceiling radiator having the same external dimensions.

This object is attained by a ceiling radiator having the features disclosed herein. Advantageous embodiments are also disclosed herein and/or are the subject matter of the dependent claims.

The basic idea of the invention in its most general form provides that the ceiling radiator has a star-shaped cross-sectional shape with five or more star tips, wherein at least two converging radiant panels form a star tip, and that a suspension is disposed in such a manner and/or the cross-sectional shape, in particular the number of the star tips, is selected in such manner that, in the mounted state on a ceiling, the radiant panels realize a larger radiating surface in a floor direction than toward the ceiling.

In this case, the invention has found that, due to the design of the cross-sectional shape and/or orientation of the ceiling radiator according to the invention, in particular a work or living area, can be heated or cooled more effectively at the floor of the room. For example, a ceiling radiator with five star tips and a suspension at one of the star tips has a larger radiation surface in the floor direction than a cross-shaped ceiling radiator. During operation, in particular the floor area of the room can be cooled or heated more quickly.

Furthermore, the bending stiffness improves with additional tips or star tips such that the dead weight or the weight per unit of length of the additional star tip, for example compared to a cross-shaped ceiling radiator, can be compensated by reduced use of materials. Due to the improved heat transmission at the same dead weight, fewer ceiling radiators can be used to save energy, for example, or to enable the use of ceiling radiators for ceilings with load restrictions.

Advantageously, the at least one flow tube is disposed in the center of the star-shaped cross-sectional shape and connects the star tips to each other at the outer diameter.

The at least one flow tube in the center of the star is preferably a circular flow tube. Compared to a rectangular flow tube, circular fluid connections are easier to be attached.

Furthermore, in addition to the flow tube in the center of the star, a flow tube may be disposed within at least one star tip. Thereby, the flow rate of cooling or heating fluid can increase while the flow velocity remains the same or the emitted or absorbed radiant power can increase.

The star tips are preferably realized in such a manner that outer corners of several star tips are distributed on a first circle and inner corners at a joint of the several star tips with the at least one flow tube in the center of the star are distributed around the central point of the cross-sectional shape on a second circle and that the several star tips form isosceles triangles.

In a further development, the angle of the star tips at the outer corners is 16° to 38°, preferably 24°, and the outer diameter of the flow tube is 25% to 42%, preferably 38%, of the circle diameter around the outer corners.

Furthermore, the star tips can be disposed with the radiant panels in such a manner that a liquid is dischargeable in the floor direction. Thus, it can, for example, be prevented that a condensate collects at the inner corners of the star tips.

Preferably, the several star tips and/or the at least one flow tube is/are producible as an extruded profile, preferably made of aluminum. Thus, a surface which is seamless in a cross-sectional direction results and the ceiling radiator is manufactured in one piece, at least in a cross-sectional direction. Advantageously, therefore, the ceiling radiator has no weld seams in the cross-sectional direction. In the case of a connection of several profiles or components in the longitudinal direction and/or when end parts are attached, of course, seams, for example weld seams, can be produced. By means of a one-piece design in the cross-sectional direction, an effective production can be achieved which, in addition, can improve the heat transmission from the flow tube to the star tips.

BRIEF DESCRIPTION OF THE DRAWINGS

Below, details and embodiments of the invention are explained with reference to merely schematic drawings.

In the figures.

DETAILED DESCRIPTION

Figure 1A:
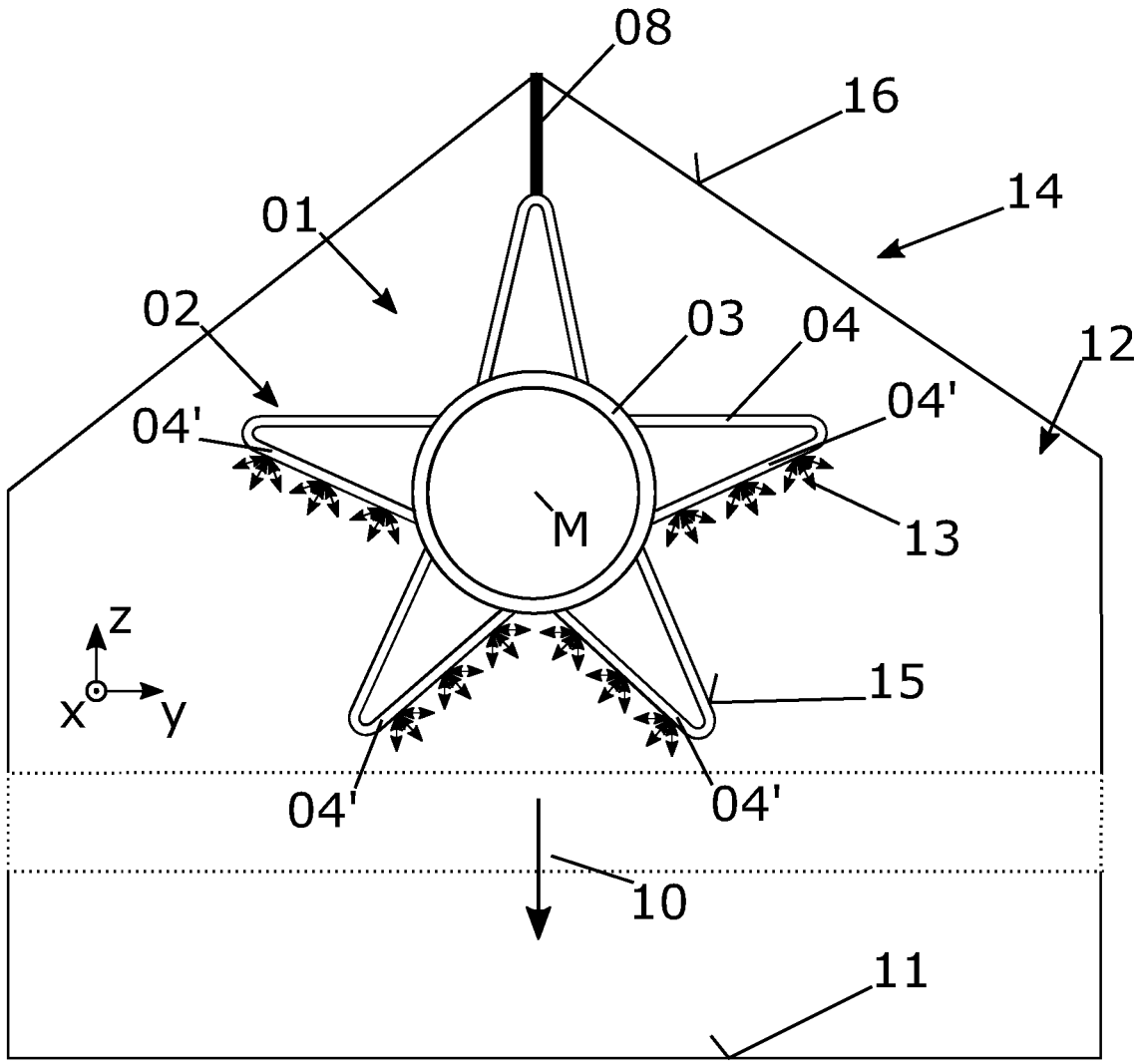
FIG. 1*a*: shows a side view of the star-shaped cross section of the ceiling radiator in a room.

In FIG. 1, a ceiling radiator 01 is illustrated which is disposed in a room 14 in a ceiling area 12. Ceiling radiator 01 has a star-shaped cross-sectional shape with five star tips 02, two converging radiant panels 04 forming one star tip 02 in each case. Star tips 02 are connected to a flow tube 03 in center M of the star-shaped cross-sectional shape.

During operation of ceiling radiator 01, a cooling or heating liquid can flow through flow tube 03 along the x-axis such that ceiling radiator 01 emits or absorbs heat radiation at star surfaces 15.

A suspension 08 from ceiling 16 is disposed at a star tip 02 such that the five star tips 02 realize a larger radiating surface 15 in a floor direction 10 than toward ceiling 16. In this case, especially radiant panels 04' are acting with illustrated heat radiation 13 in floor direction 10 to, for example, heat or cool a work or living area at floor 11. Remaining radiant panels 04 in the direction of ceiling 16 act via reflections with less intensity than radiant panels 04' on floor 11.

Alternatively, suspension 08 could be disposed on flow tube 03. However, in this case, radiating surface 15 in floor direction 10 would be reduced compared to a suspension 08 at one of star tips 02.

Flow tube 03 is preferably circular in shape such that, compared to angular flow tubes, it can easily be connected to fluid connections. In an alternative embodiment, flow tube 03 can also have a rectangular shape, for example with side surfaces corresponding to the number of star tips 02. It would also be possible that radiant panels 04 themselves form a star-shaped flow tube.

Furthermore, in addition to flow tube 03 in center M of star 01, a flow tube may be disposed within one of star tips 02. Thereby, the flow rate can be increased while the flow velocity remains the same or the emitted or absorbed radiant power can be increased.

Figure 1B:
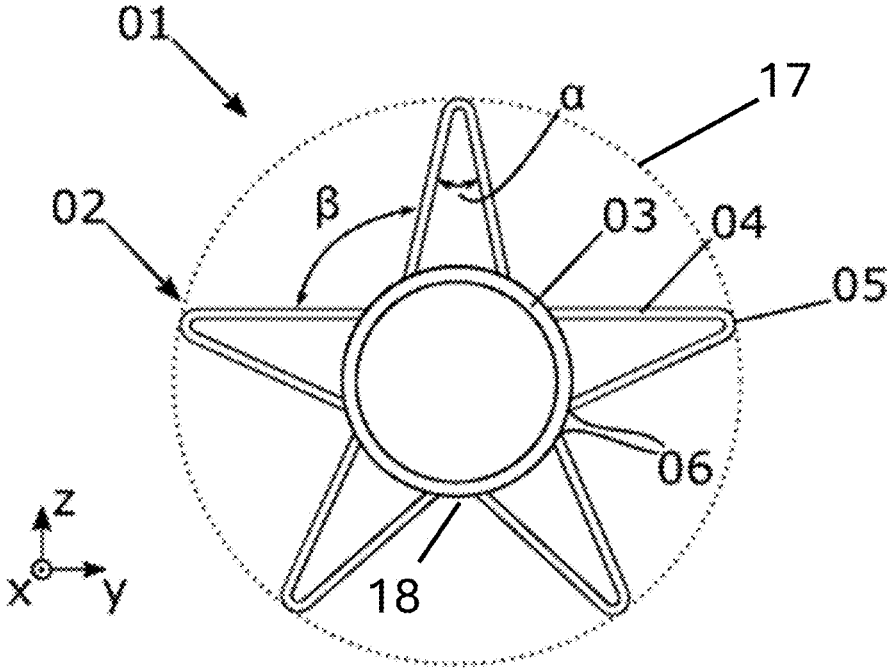
FIG. 1*b*: shows a detailed view of the ceiling radiator according to FIG. 1*a;*

Star tips 02 in FIG. 1*b* are preferably disposed in such a manner that outer corners 05 of five star tips 02 are uniformly distributed on a first circle 17 and inner corners 06 at the joint of several star tips 02 with flow tube 03 in center M of star 01 are uniformly distributed around central point M of the cross-sectional shape on a second circle 18 and that the five star tips 02 form isosceles triangles.

The triangles have a preferably same inner angle $\alpha$ between radiant panels 04. Preferably, angle $\alpha$ of star tips 02 at outer corners 05 is 16° to 38°, in the case at hand 24°. Furthermore, the outer diameter of the flow tube is 25% to 42%, in the case at hand 38%, of the circle diameter around outer corners 05.

An angle $\beta$ is also preferably designed uniformly along the circumference, the combination of angles $\alpha$ and $\beta$ increasing heat radiation 13 in floor direction 10.

Moreover, angles $\alpha$ and $\beta$ are preferably realized in such a manner that liquid, for example condensate, does not collect at inner corners 06, but is dischargeable in floor direction 10.

In the case of a desired irregular realization of angles $\alpha$ or $\beta$, it is preferred that a surface 15 of radiant panels 04 which is as large as possible is inclined at an angle which is as obtuse as possible relative to floor direction 10, wherein the surfaces preferably do not overlap. For example, individual star tips 02 can be increased to avoid overlapping.

Figure 2A:
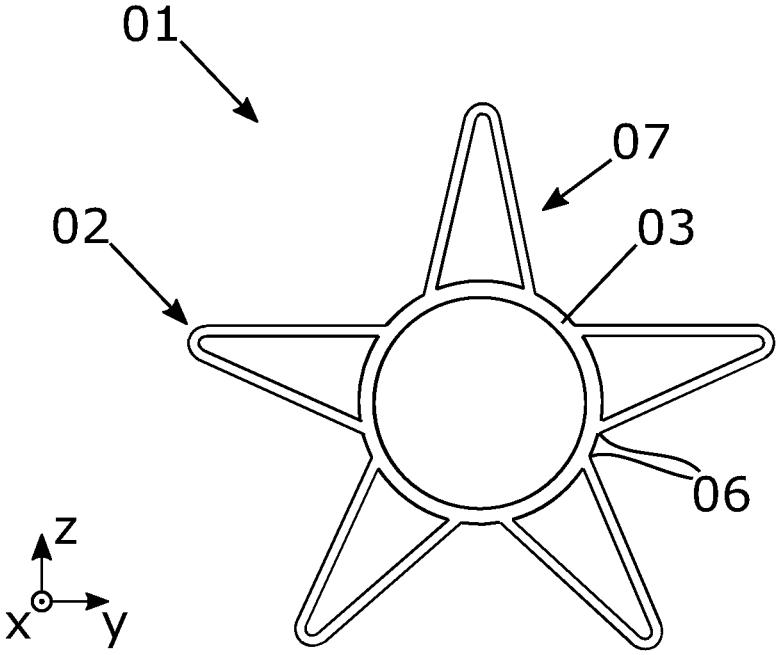
FIG. 2*a*: shows a side view according to FIG. 1*a*, the cross-sectional shape being made of one piece.
Figure 2B:
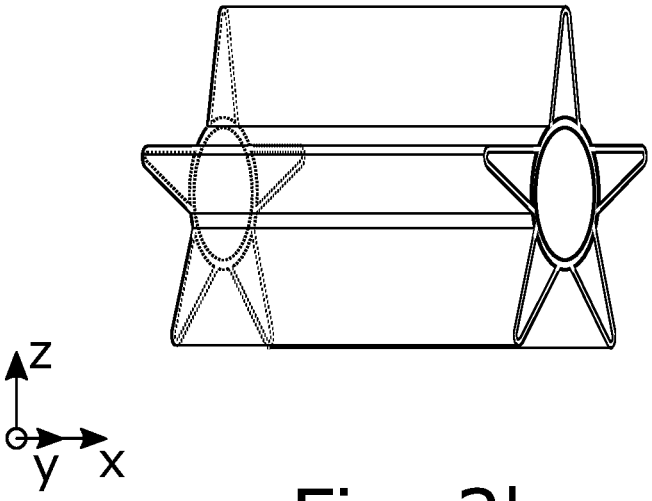
FIG. 2*b*: shows a perspective view of the ceiling radiator according to FIG. 2*a*.

Preferably, several star tips 02 and/or the at least one flow tube 03 is/are producible as an extruded profile, preferably made of aluminum or plastic. In this way, the seamless cross-sectional shape illustrated in FIG. 2*a* results. In this case, ceiling radiator 01 is made of one piece 07 in the cross-sectional direction, as illustrated in FIG. 2*b*. End parts or connecting parts, which are not shown in the sectional representation, can, of course, be provided by separate components and connected to the one-piece profile component. Advantageously, therefore, ceiling radiator 01 has no weld seams at inner corners 06 in the cross-sectional direction and the heat transmission from flow tube 03 in center M to star tips 02 can be improved. The extruded profile can have a length of 1 m to 2 m and up to 5 m in the x direction.

Ceiling radiator 01 described thus far can be altered or modified in a variety of ways without departing from the idea of the invention. Thus, for example, a larger number of star tips 02 may be used or several ceiling radiators 01 having differently disposed star tips 02 can be used in order to focus the heat radiation on a specific area at floor 11 of room 14.

LIST OF REFERENCE SIGNS

01 ceiling radiator
02 star tips
03 flow tube
04 radiant panels
04' radiant panels in the floor direction
05 outer corners
06 inner corners
07 integral cross section
08 suspension
10 floor direction
11 floor
12 ceiling area
13 heat radiation
14 room
15 radiating surface
16 ceiling
17 first circle
18 second circle

The invention claimed is:

1. A ceiling radiator (01) for heating or cooling rooms (14), said ceiling radiator (01) having at least one flow tube (03) for the transport of a heating or cooling medium and having several radiant panels (04) connected in a heat-conducting manner to the at least one flow tube (03), wherein the ceiling radiator (01) has a star-shaped cross-sectional shape with five or more star tips (02), wherein at least two converging radiant panels (04) form a star tip (02), and wherein a suspension (08) is disposed in such a manner and/or the cross-sectional shape is selected in such manner that, in the mounted state on a ceiling (16), the radiant panels (04) realize a larger radiating surface (15) in a floor direction (10) than toward the ceiling (16).

2. The ceiling radiator according to claim 1, wherein the number of the star tips (02) is selected in such manner that, in the mounted state on a ceiling (16), the radiant panels (04) realize the larger radiating surface (15) in the floor direction (10) than toward the ceiling (16).

3. The ceiling radiator according to claim 1, wherein the several star tips (02) and/or the at least one flow tube (03) is/are producible as an extruded profile.

4. The ceiling radiator according to claim 3, wherein the several star tips (02) and/or the at least one flow tube (03) is/are made of aluminum.

5. The ceiling radiator according to claim 1, wherein the at least one flow tube (03) is disposed in the center M of the star-shaped cross-sectional shape.

6. The ceiling radiator according to claim 5, wherein the at least one flow tube (03) in the center M of the star (01) is a circular flow tube (03).

7. The ceiling radiator according to claim 5, wherein outer corners (05) of several star tips (02) are uniformly distributed on a first circle (17) and inner corners (06) at the joint of the several star tips (02) with the at least one flow tube (03) in the center M of the star (01) are uniformly distributed around the central point M of the cross-sectional shape on a second circle (18), and wherein the several star tips (02) and the at least two converging radiant panels (04) that define each of the several star tips (02) form isosceles triangles.

8. The ceiling radiator according to claim 5, wherein in addition to the flow tube (03) in the center M of the star (01), a flow tube (03) is disposed within at least one star tip (02).

9. The ceiling radiator according to claim 8, wherein the angle x of the star tips (02) at the outer corners (05) is 34° to 38° and the outer diameter of the flow tube is 25% to 42% of the circle diameter around the outer corners.

10. The ceiling radiator according to claim 9, wherein the star tips (02) are disposed with the radiant panels (04) in such a manner that a liquid on the radiating surfaces (15) is dischargeable in the floor direction (10).

11. The ceiling radiator according to claim 9, wherein the angle x of the star tips (02) at the outer corners (05) is 36°, and the outer diameter of the flow tube is 38%, of the circle diameter around the outer corners.

* * * * *